US006416369B1

(12) United States Patent
Coakley

(10) Patent No.: US 6,416,369 B1
(45) Date of Patent: Jul. 9, 2002

(54) UNDERWATER TOWING OF MARINE VESSELS

(75) Inventor: David B. Coakley, Hyattsville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/919,990

(22) Filed: Apr. 12, 2001

Related U.S. Application Data

(63) Continuation-in-part of application No. 09/599,580, filed on Jun. 22, 2000, now Pat. No. 6,260,500.

(51) Int. Cl.[7] ..... B63B 21/56
(52) U.S. Cl. ..... 440/33; 114/242
(58) Field of Search ..... 440/6, 7, 38, 53, 440/33, 34, 40; 114/162, 242, 253, 221 R, 51

(56) References Cited

U.S. PATENT DOCUMENTS 612,539 A * 10/1898 Bowick ..... 440/33
1,795,346 A * 3/1931 Rebl ..... 114/162
3,522,788 A * 8/1970 Montague, Jr. ..... 440/6
4,938,722 A * 7/1990 Rizley ..... 440/6
5,094,638 A * 3/1992 Kobayashi ..... 440/42
5,417,597 A 5/1995 Levedahl
5,601,461 A * 2/1997 Mills ..... 440/6
5,642,330 A 6/1997 Santopietro
6,132,267 A * 10/2000 Campbell ..... 440/6
6,189,475 B1 2/2001 Coakley

* cited by examiner

*Primary Examiner*—Stephen Avila
(74) *Attorney, Agent, or Firm*—Jacob Shuster

(57) ABSTRACT

A marine vessel is propelled under maneuvering control in a selected direction and travel speed through a body of seawater, by propulsion exclusively provided for by one or more submerged towing module pods attached to the underside of the vessel hull at locations between its bow and stern. Each of such towing pods may be attached to the vessel and spaced therebelow by an elongated cable so constructed for enclosure within a drag reducing fairing. Each of such cables has internal portions thereof arranged to electrically conduct current between the marine vessel and the towing pod for controllable operation of its propulsive equipment, while transferring the mechanical towing force so produced to the vessel.

9 Claims, 2 Drawing Sheets

UNDERWATER TOWING OF MARINE VESSELS

The present invention relates in general to propulsion of marine vessels through a body of water, exclusively by submerged towing facilities attached thereto as disclosed in a prior copending application, Ser. No. 09/599,580, filed Jun. 22, 2000, now U.S. Pat. No. 6,260,500, issued Jul. 17, 2001, with respect to which the present application is a continuation-in-part.

BACKGROUND OF THE INVENTION

The propulsion of marine vessels by means of underwater submerged modules or pods attached to the vessel hull, are generally known in the art as disclosed for example in U.S. Pat. No. 5,417,597 to Levedahl and also in the aforesaid prior copending continuation-in-part application, Ser. No. 09/599,580, filed Jun. 22, 2000 now U.S. Pat. No. 6,260,500 issued Jul. 17, 20001, for towing of a vessel in distress. Also known in the art, is the towing of underwater submerged bodies or pods by attachment to a self-propelled marine vessel, as disclosed for example in U.S. Pat. No. 5,642,330 to Sautopietro. However, the use of underwater submerged pods as the only means for propulsion of the marine vessel to which it is attached, was not heretofore achieved, by reason of which it is an important object of the present invention to provide for normal propulsion of a marine vessel exclusively by submerged underwater pods attached thereto, since it may provide certain advantages over current comparable methods for propelling marine vessels.

SUMMARY OF THE INVENTION

In accordance with the present invention, one or more submerged towing pods having electrical motor driven propellers and controllable maneuvering facilities associated therewith, are respectively attached to the underside of a marine vessel hull at spaced locations between its bow and stern. Such marine vessel hull does not have any propulsion propeller, but does enclose an electric power generator as a source of electrical energy for operation of the propeller driving motor and propulsion maneuvering facilities associated therewith on each of the towing pods. According to certain embodiments of the invention, each of the towing pods is attached to the marine vessel hull through an elongated flexible cable enclosed within a drag reducing fairing. A plurality of electrical conductors are protectively enclosed within each of such cables, constructed for enhanced transmission of electrical power and signals between the marine vessel and the towing pod, while effectively transferring the towing force produced in the pods to the hull of the marine vessel.

DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
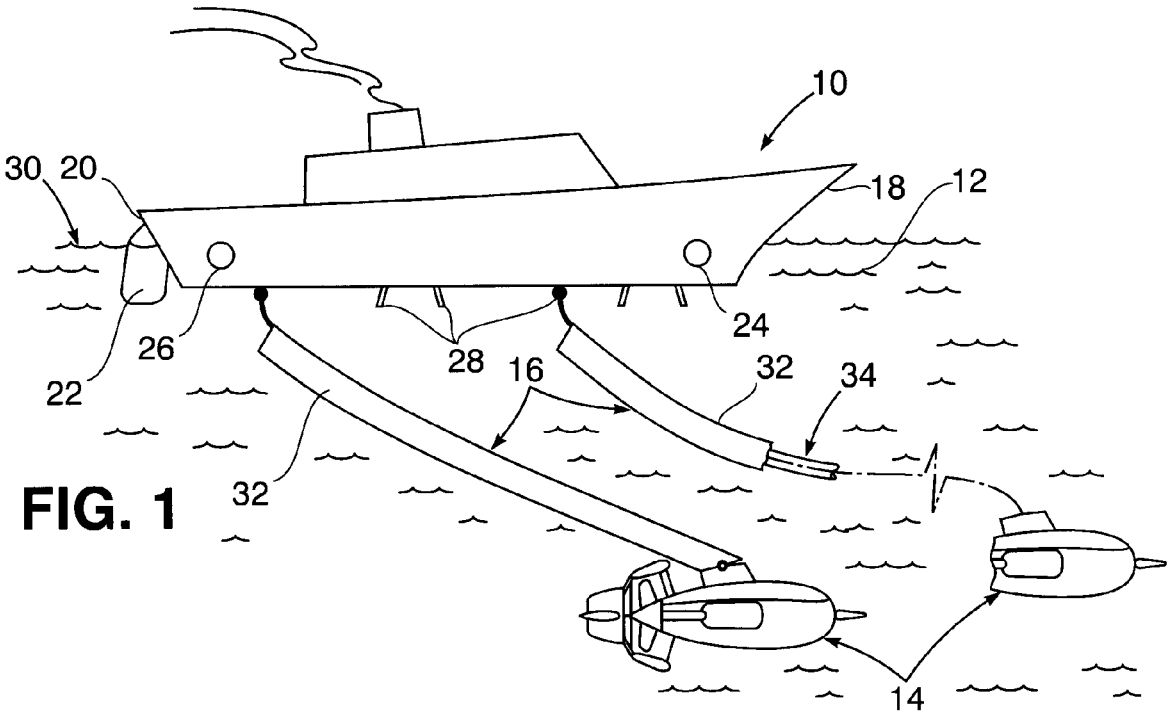
FIG. 1 is a simplified side elevation view of a marine vessel undergoing travel in a body of seawater in accordance with one embodiment of the present invention.

Referring now to the drawing in detail, FIG. 1 illustrates the hull of a marine vessel or ship 10 moving through a body of water 12 under tow of a pair of identical submerged towing pods 14. Each of such towing pods is attached by an elongated cable 16 to the underside of the ship 10, one closer to the bow 18 of the ship and the other closer to the ship's stern 20. The ship 10 does not have its own propeller, in view of the primary propulsion provided for it under maneuvering control by the towing pods 14, but does have at least one rudder 22 on its stern 20. Additionally, thrusters 24 and 26 are provided on the sides of the ship 10, respectively adjacent to its bow 18 and stern 20. Also, a plurality of pod attachment locations 28 are provided on the underside of the ship as shown in FIG. 1, at which one or more of the towing pods 14 may be attached closer to the water surface 30 than the lower submerged locations at which two of such pods 14 are located at the ends of the cables 16 for normal seawater propulsion of the ship 10 in a selected direction and travel speed.

Figure 2:
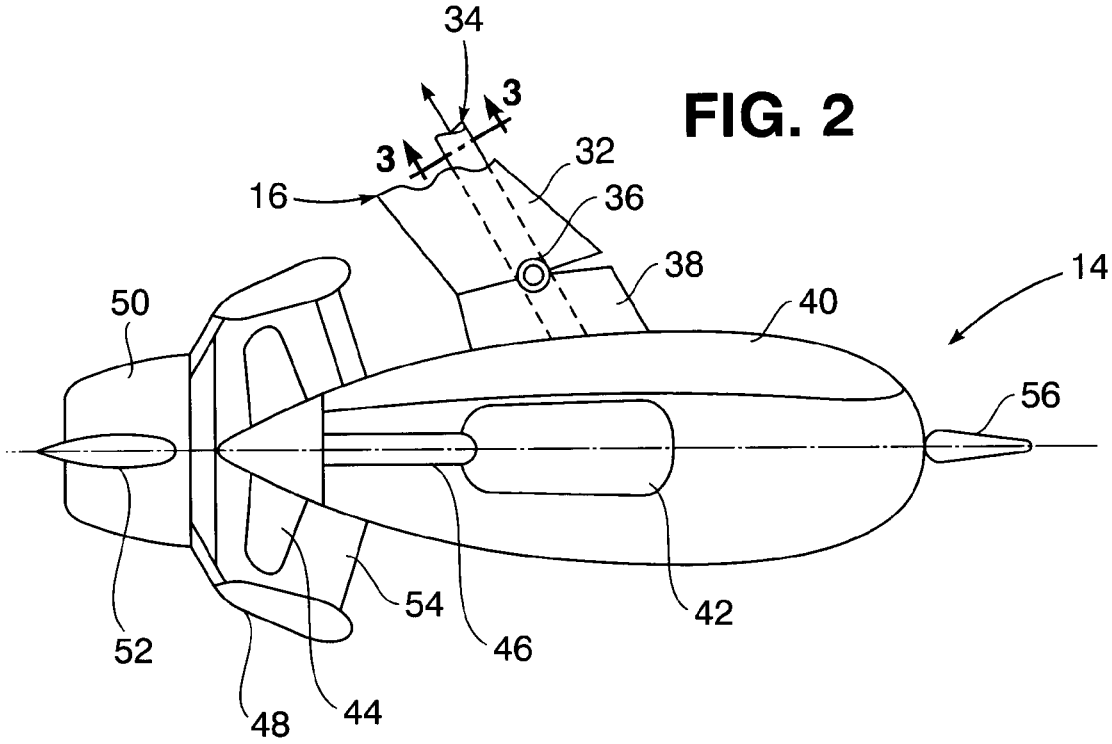
FIG. 2 is an enlarged schematic side elevation view of one of the towing pods shown in FIG. 1.

Each of the cables 16 has a fairing 32 for reducing drag and an enclosed cable portion 34 extending therethrough between the hull of the ship 10 and one of the pods 14 for and the pod 14 and mechanical transfer of towing force generated in the pods 14 for propulsion purposes. As shown in FIG. 2, the lower end of the fairing 32 of each cable 16 is pivotally connected by a clevis joint 36 to a coaming 38 projecting from an outer ballast portion of the pod 14.

With continued reference to FIG. 2, each of the towing pods 14 includes an electric motor 42 to which the electrical power is delivered for imparting propulsive rotation to a propeller 44 through a propeller shaft 46. Such propeller 44 is enclosed within a shroud 48 from which a turn controlling rudder 50 extends aftward, having horizontal stabilizers 52 thereon to effect diving and rising maneuvers. Vanes 54 are provided in the shroud 48 forwardly of the blades of the propeller 44 to induce preswirl. Attitude maneuvering control for the pods 14 is also provided for through a forward canard 56. Such maneuvering controls through the rudder 50 and vanes 52 and 56 are effected in response to instrumentation signals derived from sensors and from personnel commands as generally known in the art. The electrical signal energy for such maneuvering controls as well as the power for propulsive energization of the propeller motor 42 is transmitted between the ship 10 and the pods 14 through the cable portion 34 of each cable 16 as illustrated in FIG. 3.

Figure 3:
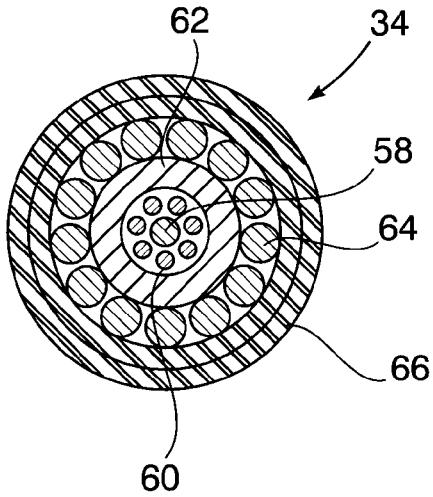
FIG. 3 is an enlarged transverse section view of a portion of one of the towing cables shown in FIGS. 1 and 2, taken substantially through a plane indicated by section line 3—3 in FIG. 2.

With continued reference to FIG. 3 the cable portion 34 includes a cross-sectionally central conductor 58 through which the aforesaid sensor instrumentation signals are conducted while maneuvering control by means of electrical current is transmitted through conductors 60 disposed in surrounding relation to the conductor 58. Such conductors 58 and 60 are enclosed within a tubular tension section 62 of the cable portion 34 through which mechanical transfer of towing force is effected and on which a plurality (13) of electrical power conductors 64 are supported for delivery of electrical power to the propeller motor 42. Physical protection for the cables is afforded by one of many combinations of metal braid and rubber coatings, as known in the art. Insulation cover 66 protectively encloses all of the electrical conductors 58, 60 and 64.

Based on the foregoing disclosure, involving installation of the two pods 14 with associated features thereof, a computer control system on board the ship 10 may be utilized to effect maneuver regulated propulsion by receiving signals from sensors on such pods 14 in regard to altitude, depth and cable tension. Also, traditional command signals from the bridge of the ship 10 are inputted to the computer, such as speed and rudder angle. As an alternative, a fiber optic line may replace the control cables 58 so that control functions may be governed by a computer on board each of the pods. Where a single pod 14 is utilized, control thereover may be manually initiated.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a marine vessel having a power generator therein, a system for propulsion of the marine vessel through a body of water under maneuvering control in a selected direction and travel speed, including: at least one towing pod separated from the hull having a propeller motor, a rudder and maneuvering control vanes; and flexible attachment means connecting said towing pod in spaced relation to an underside of the marine vessel submerged in the body of water for electrical transmission of power and control signals from the generator in the marine vessel to the towing pod and mechanical transfer therefrom of towing force under said maneuvering control to the marine vessel to exclusively impart said propulsion through the body of water.

2. The combination as defined in claim 1, wherein said flexible attachment means includes: an elongated cable having electrical current conductors therein through which said electrical transmission is effected and a tubular tension section through which said mechanical transfer is effected.

3. The combination as defined in claim 2, wherein said flexible attachment means further includes: fairing means enclosing the elongated cable between the marine vessel and the towing pod for reducing drag of the water during said propulsion of the marine vessel.

4. The combination as defined in claim 3, wherein the propulsion system further includes a plurality of said towing pods respectively provided with a plurality of said flexible attachment means.

5. The combination as defined in claim 1, wherein the propulsion system further includes a plurality of said towing pods respectively provided with a plurality of said flexible attachment means.

6. The combination as defined in claim 5, wherein each of said flexible attachment means includes: an elongated cable having electrical current conductors therein through which said electrical transmission is effected and a tubular tension section through which said mechanical transfer is effected.

7. The combination as defined in claim 5, wherein each of said flexible attachment means includes: fairing means between the marine vessel and the towing pod for reducing drag of the water during said propulsion of the marine vessel.

8. A method for propulsion of a marine vessel having a hull and an electrical power source therein through a body of water by means of at least one electrically powered propulsion module separated from the hull by an elongated cable, including the steps of: submerging said module within the body of water beneath the hull of the marine vessel; transferring towing force through the cable from said submerged module to the hull of the marine vessel for exclusively effecting said propulsion of the marine vessel; and transmitting electrical energy between the power source in the hull and the submerged module for generating therein said towing force under directional control.

9. The method as defined in claim 8, wherein both said transmitting of the electrical energy and said transferring of the towing force are conducted through said elongated cable interconnecting the submerged module in spaced relation to the hull.

* * * * *